US012163398B2

(12) United States Patent
Fairweather

(10) Patent No.: US 12,163,398 B2
(45) Date of Patent: Dec. 10, 2024

(54) METHOD RELATING TO WELL ABANDONMENT

(71) Applicant: Ardyne Holdings Limited, Aberdeen (GB)

(72) Inventor: Alan Fairweather, Aberdeen (GB)

(73) Assignee: ARDYNE HOLDINGS LIMITED, Aberdeen (GB)

( * ) Notice: Subject to any disclaimer, the term of this patent is extended or adjusted under 35 U.S.C. 154(b) by 211 days.

(21) Appl. No.: 17/439,619

(22) PCT Filed: Mar. 26, 2020

(86) PCT No.: PCT/EP2020/058572
§ 371 (c)(1),
(2) Date: Sep. 15, 2021

(87) PCT Pub. No.: WO2020/193710
PCT Pub. Date: Oct. 1, 2020

(65) Prior Publication Data

US 2022/0154547 A1 May 19, 2022

(30) Foreign Application Priority Data

Mar. 27, 2019 (GB) ..... 1904222

(51) Int. Cl.
*E21B 33/13* (2006.01)
*E21B 37/00* (2006.01)
*E21B 43/116* (2006.01)

(52) U.S. Cl.
CPC ..... *E21B 33/13* (2013.01); *E21B 37/00* (2013.01); *E21B 43/116* (2013.01)

(58) Field of Classification Search
CPC ..... E21B 29/00; E21B 33/13; E21B 37/00; E21B 43/11; E21B 43/116
See application file for complete search history.

(56) References Cited

U.S. PATENT DOCUMENTS 4,459,480 A 7/1984 Dimon
6,279,670 B1 8/2001 Eddison et al.
(Continued)

FOREIGN PATENT DOCUMENTS

GB 2499172 B 12/2013
GB 2505089 B 5/2015
(Continued)

OTHER PUBLICATIONS

Intellectual Property Office of the UK Patent Office; Search Report for GB1904222.5; five pages; Aug. 15, 2019; Intellectual Property Office of the UK Patent Office, Newport, South Wales, United Kingdom.

(Continued)

*Primary Examiner* — Daniel P Stephenson
(74) *Attorney, Agent, or Firm* — LAW OFFICE OF JESSE D. LAMBERT, LLC

(57) ABSTRACT

A method for well abandonment in a cased well bore by perforating, washing and cementing to provide a plug over a longitudinal section of the well, wherein logging of the washed outer annulus is performed to evaluate the effectiveness of the wash and determine the most appropriate plugging technique. One of perf, wash and cement; cut and pull; and section milling are described dependent upon the material left in the outer annulus following the washing step. Verification of the washing step in a perf wash and cement well abandonment procedure is obtained.

16 Claims, 3 Drawing Sheets

(56) References Cited

U.S. PATENT DOCUMENTS

| | | | | |
|---|---|---|---|---|
| 7,077,205 | B2 | 7/2006 | Eddison | |
| 8,863,836 | B2 | 10/2014 | Coludrovich, III | |
| 9,045,958 | B2 | 6/2015 | Eddison | |
| 9,797,240 | B2 * | 10/2017 | Tunget | E21B 47/024 |
| 10,989,017 | B2 * | 4/2021 | Wardley | E21B 47/005 |
| 11,047,193 | B2 * | 6/2021 | Fairweather | E21B 31/005 |
| 11,053,761 | B2 * | 7/2021 | Fairweather | E21B 33/12 |
| 11,613,953 | B2 * | 3/2023 | Linklater | E21B 17/06 166/255.1 |
| 2010/0310384 | A1 * | 12/2010 | Stephenson | F04B 47/00 417/53 |
| 2012/0312549 | A1 * | 12/2012 | Eddison | E21B 29/00 166/98 |
| 2015/0021025 | A1 * | 1/2015 | Myhre | E21B 21/00 166/113 |
| 2015/0047845 | A1 * | 2/2015 | Larsen | E21B 31/16 166/298 |
| 2015/0053405 | A1 | 2/2015 | Bakken | |
| 2021/0079748 | A1 * | 3/2021 | Wardley | E21B 33/13 |
| 2022/0154547 | A1 * | 5/2022 | Fairweather | E21B 43/11 |

FOREIGN PATENT DOCUMENTS

| | | | | |
|---|---|---|---|---|
| GB | 2514278 | B | 6/2015 | |
| GB | 2563236 | A | 12/2018 | |
| GB | 2569565 | A | 6/2019 | |
| WO | WO 2013/109248 | A1 | 7/2013 | |
| WO | WO-2015026239 | A2 * | 2/2015 | E21B 33/12 |
| WO | WO 2015/115905 | A1 | 8/2015 | |
| WO | WO-2016156862 | A2 * | 10/2016 | E21B 29/00 |
| WO | WO-2018224819 | A1 * | 12/2018 | E21B 33/12 |

OTHER PUBLICATIONS

European Patent Office as ISA, International Search Report for PCT/EP2020/058572; Jun. 2, 2020; eleven pages; European Patent Office, Rijswijk, The Netherlands.

Society of Petroleum Engineers International, "Novel Approach to More Effective Plug and Abandonment Cementing Techniques," SPE 148640; SPE Journal; Oct. 18, 2011; 13 pages; SPE International; Moscow, Russia.

* cited by examiner

METHOD RELATING TO WELL ABANDONMENT

The present invention relates to methods and apparatus for well abandonment and in particular, though not exclusively, to a method and apparatus for perforating, washing and cementing to provide a cement plug across a longitudinal section of the well.

When a well has reached the end of its commercial life, the well is abandoned according to strict regulations in order to prevent fluids escaping from the well on a permanent basis. In meeting the regulations it has become good practise to create the cement plug over a predetermined length of the well. As a well is constructed by locating conduits such as casing, lining and tubing into the well, the cement plug must extend over all annuli present in the well. In many cases all conduits are removed leaving the outer casing, including the annulus bounded by the formation.

A preference has been to remove the outer casing to allow creation of a cement plug extending to the formation. This is referred to as cut and pull but requires a number of trips into the well to cut and pull sufficient length of casing. A difficulty with this technique is also in the ability to free stuck casing. The presence of material in the annulus can act as a binding material limiting the ability to free the casing when pulled. This material may be various particles, deposits, for example so-called filter cake, and fluids remaining from previous downhole operations, including remaining drill cuttings, cement residues, baryte deposits and/or drill fluid.

Alternately, one can mill away the outer casing to expose the annulus behind the casing and then pump cement into the enlarged area to create the cement plug. This method of section milling is expensive as the length of the cement plug is typically 30 to 75 metres, removal of a section of conduit weakens the structure of the well, and several trips must be made into the well to change the milling head for different sizes of casing used through the wellbore.

An alternative method perforates the casing and pumps cement through the perforations to travel up the annulus and thereby create a plug within the annulus. While this 'perf and plug' arrangement is much quicker to perform, saving significant time and costs as the casing is not recovered or removed, it has disadvantages in that the material present in the annulus can restrict the flow and the adhesion of the cement and thus the required sealing of the plug is not achieved.

Techniques which introduce a washing step to the 'perf and plug' arrangement, termed 'perf, wash and cement' have been performed according to GB2499172 to Hydra Systems AS and WO2015115905 to Archer Oil Tools. Here a wash tool normally either having opposed swab cups or jet nozzles, forces a washing fluid through the perforations and into the annulus to sweep away the material and clean the casing surfaces. Later pumped cement can then adhere to the clean casing to create an adequate cement bond while entirely filling the annulus and casing bore with cement.

However, if we consider an example perforated casing, say, a 9⅝" (244 mm) casing perforated using a perforation gun which operates at 12 shots per foot with each perforation having an 0.75" (19 mm) diameter. The perforated area over 1 foot of casing is 5.3 Sq. inches (3419 $mm^2$) to a casing area of 321.8 Sq. inches (0.21 $m^2$). This equates to only 1.65% of the casing area being open. Consequently, in perf wash and cement, the annulus must be cleaned, mud displaced and cement effectively placed through an access or open area of less than 2% i.e. 1/60th of the area which needs to be over several hundred feet (100 ft=30.48 m) of casing. Additionally, wells can be vertical, horizontal or inclined which can alter the washing effectiveness. Additionally, the materials present in the annulus can also dictate the potential effectiveness of the washing step.

It is recommended practise to perform annular space logging evaluation before the perf wash and cement job is undertaken (FERG ET AL: "Novel Approach to More Effective Plug and Abandonment Cementing Techniques", SPE Arctic and Extreme Environments Conference and Exhibition, dated Oct. 18, 2011, pages 1-13, XP055167744, Moscow, Russia). These cement evaluation logs are useful in determining if cement stringers or channelled cement is present or whether the formation has collapsed around the casing. Plug setting intervals are then chosen based on setting depth requirements and across intervals where free pipe is indicated.

The perf wash and cement technique relies on getting both the washing fluid and the plugging material through the perforations and into the annulus with the washing fluid requiring to clean the casing and sweep the annulus and the plugging material adhering to the casing.

The present Applicants have developed a technique for improved washing disclosed in GB2563236, in which pressure variations are created in the washing fluid by use of a flow modifier device to pulse the washing fluid. By creating pulses in the washing fluid a vibration assisted clean is achieved which improves the washing step to provide for better adhesion of the cement to the walls in creating the cement plug. The vibration can also be used to assist the cement placement.

Tools have also been developed to aid in getting the cement to enter the perforations as disclosed in GB2505089 to Hydra Systems AS and for flushing in a well which aids in getting the washing fluid into the annulus as disclosed in GB2519240 to Hydra Systems AS.

It is an object of the present invention to provide a method of abandoning a well which obviates or mitigates at least some of the disadvantages in the prior art.

According to a first aspect of the present invention there is provided a method for well abandonment, in which the well bore has a conduit therein with an outer annulus behind the conduit, the method comprising the steps, in order:

(a) perforating the conduit to form a plurality of holes in the conduit over a longitudinal section of the well bore;
(b) passing a washing fluid into the outer annulus via at least one of said holes to wash the outer annulus;
(c) logging at least a portion of the washed outer annulus;
(d) pumping a fluidised plugging material into the well to create a plug over at least a portion of the longitudinal section of well bore.

By performing a log directly after the wash step, an evaluation of material remaining in the outer annulus and adhering to the conduit can be made. This allows a decision to be made on the best technique for plugging and abandoning the well.

The method may include repeating steps (b) and (c) between steps (c) and (d). This would be repeating the washing step and logging again if the evaluation showed a nearly complete clean.

The method may include pumping the fluidised material through at least one of said holes in step (d). This would abandon the well using a perf wash and cement technique. This would be the selected technique if the log evaluation showed no remaining material in the outer annulus or adhering to the conduit. In this way, the wash step in a perf wash and cement procedure has been verified.

The method may include the steps of cutting and pulling the perforated conduit from the well bore between steps (c) and (d). This would abandon the well using a cut and pull technique. This would be the selected technique if the log evaluation showed a substantially clear outer annulus with only remaining material adhering to the conduit, the remaining material in the annulus has at least one flow path therethrough over the longitudinal section, or blockages in the outer annulus are small and it is considered that a sufficient pulling force can be made to the cut casing to remove it. In this way, a perf wash and cement job is not performed when it is known that the cement plug would be unreliable.

The method may include the step of milling the conduit between steps (c) and (d). This would abandon the well using a section milling technique. This would be the selected technique if the log evaluation showed significant material remaining in the outer annulus which would cause the casing to be stuck if pulling was to be attempted. In this way, a perf wash and cement job is not performed when it is known that the wash has been ineffectual and any cement plug would be unsafe.

Preferably, in step (c) logging is performed by a logging tool located on a string run into the conduit. Any logging technique may be used. A non-exhaustive list of possible techniques include cement bond logs (CBL), cement mapping logs (CMT), ultrasonic cement mapping tools (CET), and ultrasonic imaging logs (USI, RBT).

The method may include the additional step of logging the well prior to step (a). In this way, the most suitable location in the well for a plug can be determined. Unlike the prior art perf wash and cement procedure which requires determination of a sufficient length of free pipe from an initial log, the present method allows selection of longitudinal sections of the wellbore having uncertain material characteristics from the log and offers the possibility of using the wash step to determine if these materials can be dislodged, broken down or moved.

The method may include creating pressure variations on the washing fluid. Preferably the pressure variations are created by use of a flow modifier device. More preferably, the pressure variations are pressure pulses created in the washing fluid. By agitating the washing fluid this will assist in dislodging stuck material in the annulus so that it can be lifted and swept from the annulus and so improve cleaning and the subsequent placing of cement.

The method may include creating pressure variations on the fluidised plugging material. In this way, the cement is encouraged to distribute more evenly through the outer annulus and conduit if the chosen technique is perf wash and cement. More preferably, the pressure variations in the fluidised plugging material is by use of the flow modifier device. More preferably, the pressure variations are pressure pulses created in the fluidised plugging material. More preferably the flow modifier device is operated by pumping the fluidised plugging material through the device to thereby create pressure pulses in the fluidised plugging material. In this way, the flow modifier device can be used to assist both in washing and cementing.

Preferably, in step (a) perforating is by operation of a perforating tool located on a string run into the conduit. The perforating tool may be a perforating gun as is known in the art. In this way, known tools may be used. Alternatively, the perforating tool may be a punch tool being combined with an anchor to allow the punch tool to be operated by tension. In this way, the annulus is accessed quickly and inexpensively to conduct the washing step. compared to section milling the conduit. Perforation of the conduit may be performed in stages over the longitudinal section. In this way, a perforating tool having a length shorter than the longitudinal section can be used and thus the length of the longitudinal section is not restricted by the perforating tool length. Typical longitudinal section lengths may be several hundred feet (100 ft=30.48 m).

Preferably, the step of passing the washing fluid through the outer annulus is by jetting washing fluid from ports in a wash tool located on a string run into the conduit. In this way, fluid from the wash tool is directed into the outer annulus. Alternatively or additionally, swab cups or other diverting means may be used on the wash tool to direct fluid into the outer annulus. Brushes or scrapers may also be used on the wash tool to clean the inner surface of the conduit.

Preferably the fluidised plugging material is cement. More preferably, the fluidised plugging material is pumped from surface through a cementing tool located on a string run into the conduit. The cementing tool may include blades to encourage the fluidised plugging material to pass through the holes and enter the outer annulus.

The method may include the step of setting a bridge plug in the conduit. In this way, fluid entering the conduit is prevented from travelling downhole.

The method may include performing step (c) as a separate trip in the wellbore. Preferably, the method includes performing the steps on a single trip in the wellbore.

The method may include providing a perforating tool, a wash tool, a logging tool and a cementing tool on the same string and performing the method on a single trip in the wellbore. Alternatively, the method may include providing a perforating tool, a wash tool and a cementing tool on the same string and running the logging tool through the string to perform step (c) with the string remaining in the wellbore to perform steps (a), (b) and (d).

The method may include providing a perforating tool, a wash tool, a logging tool, a cementing tool, a casing cutter, a casing spear and a section mill on the same string and performing the method on a single trip in the wellbore together the step of evaluating the log and performing a plugging and abandonment technique from a group comprising: perf, wash and cement; cut and pull; and section milling.

Preferably, the string is a coiled tubing string. Alternatively, the string may be a drill string.

Preferably, the conduit is casing and the outer annulus is between the casing and the formation of the borehole. Optionally, the outer annulus is the B-annulus between inner casing and a surrounding casing.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

Embodiments of the present invention will now be described, by way of example only, with reference to the accompanying drawing:

FIGS. 1(*a*)-(*h*) illustrate a method for abandoning a well, according to an embodiment of the present invention;

Figure 1C:
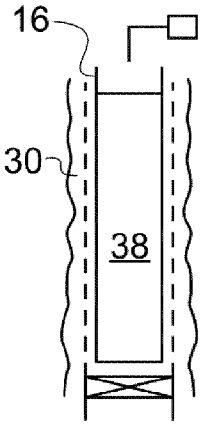
Figure 1B:
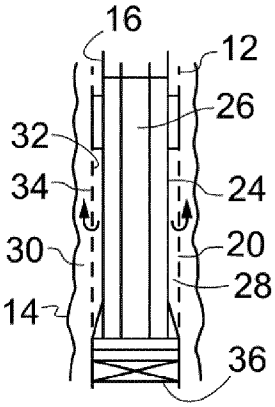
Figure 1A:
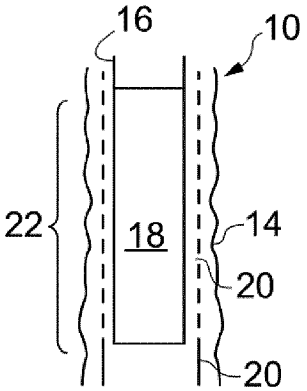
Figure 1D:
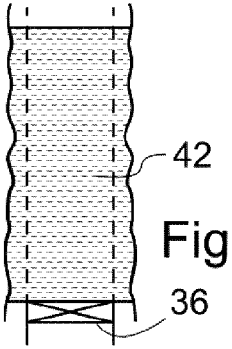
Figure 1E:
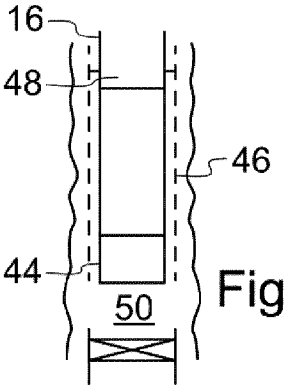
Figure 1G:
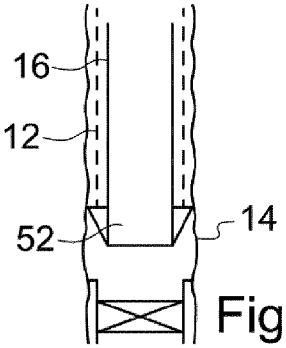
Figure 1F:
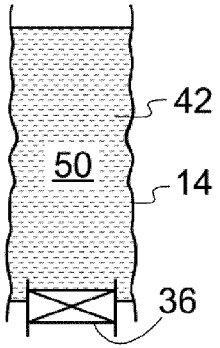
Figure 1H:
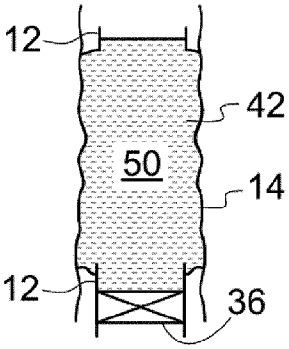

Reference is initially made to FIGS. 1(*a*) to 1(*h*) which illustrate steps in a method for well abandonment according to an embodiment of the present invention. In FIG. 1(*a*) there is shown a cased well bore, generally indicated by reference numeral 10, in which conduit in the form of casing 12 lines the bore 14. A tool string 16 is run in the casing 12. Tool string 16 includes a perforating tool 18 mounted thereon. The perforating tool 18 is a perforating gun which is known in the art. The perforating gun produces multiple holes 20 or perforations through the casing 12. However, the perforating tool 18 may be any tool which can create individual holes 20 in casing 12. The tool string 16 is run in the well 10 and the casing 12 is perforated along a length 22. Ideally the length is equivalent to that over which a plug is to be formed. This can be up to several hundred feet (100 ft=30.5 m). A number of perforating guns 18 can be arranged along the length of the string 16 to form the desired length 22, or the string 16 can be moved and guns fired sequentially.

Following the perforation step, the well 10 is then washed and cleaned. FIG. 1(*b*) illustrates a wash tool 24 on the tool string 16 run-in to the casing 12. The wash tool 24 may be any device which ejects a cleaning fluid from within a throughbore 26 of the string 16 to an inner annulus 28 between the string 16 and the casing 12, through the perforations 20 and into an outer annulus 30, between the casing and the bore 14 or formation wall. Tools such as those described in GB2499172, WO2015115905, GB2563236 and GB2505089 which are all incorporated herein by reference may be used as the wash tool 24. The outer annulus 30 is behind the casing 12 and will typically contain materials which have been deposited or settled during or after completion of the well 10. This material may be various particles, deposits, for example so-called filter cake, and fluids remaining from previous downhole operations, including remaining drill cuttings, cement residues, baryte deposits and/or drill fluid.

The washing step, as shown in FIG. 1(*b*), uses cleaning fluid from the wash tool 24 to wash the inner 32 and outer 34 surface walls of the casing 12 and remove any materials therefrom. The wash should also clear the material from the outer annulus 30. However, as detailed in the introduction, perforating the casing 12 provides an extremely small access area (2%), into the outer annulus 30 for the washing fluid. Wash tools 24 may include swab cups or other directional means to guide fluid into the outer annulus 30. Scrapers and brushes may also be present to mechanically clean material from the inner surface 32 of the casing 12. There may also be nozzles at the fluid exit ports to jet the fluid into the outer annulus 30. A bridge plug 36, cement retainer or other sealing device may be located in the casing 12 to prevent the fluids from travelling down the casing and thus direct more of the wash fluid into the outer annulus 30. Other washing techniques may also be used such as agitating the washing fluid, creating pulses in the washing fluid using a flow modifier 40 and sweeping the washing fluid to create a vortex to move the fluid towards the casing 12 by a centrifugal force.

It is the effectiveness of this wash step which is crucial to the integrity of a cement plug for a perf wash and cement operation. Current techniques rely on an initial logging step to select a longitudinal section which is free of material not capable of being washed away e.g. cement stringers or channelled cement. This limits the potential locations in the well for a plug to be set over. Once the wash and cementing is complete in the perf wash and cement operation, the set plug is then drilled out so that a cement bond log can be undertaken of the outer annulus to provide competency verification. A further cement plug is placed inside the casing if the log is verified with the further plug being separately tested also. If the cement bond log of the outer annulus is not verified as sufficient, then remedial operations are required to mill the cemented casing and set a plug extending to the bore 14.

The present invention instead takes a log after the washing step and before any plugging material such as cement is used. FIG. 1(*c*) illustrates this step with a logging tool 38 now located on the tool string 16 and run-in the well 10. Any logging technique may be used. A non-exhaustive list of possible techniques include cement bond logs (CBL), cement mapping logs (CMT), ultrasonic cement mapping tools (CET), and ultrasonic imaging logs (USI, RBT). 360 degree images around the circumference of the casing 12 are preferably collected along the longitudinal section 22. The logging tool 38 preferably sends data back to surface in real time. In this way, analysis can be done as quickly as possible to determine the effectiveness of the washing step. The log or logs, as multiple tools 38 may be used, are evaluated and one of the following determinations is made:

1. The log evaluation shows little to no remaining material in the outer annulus or adhering to the casing;
2. The log evaluation shows a substantially clear outer annulus with only remaining material adhering to the casing, the remaining material in the annulus has at least one flow path therethrough over the longitudinal section, or blockages in the outer annulus are small and it is considered that a sufficient pulling force can be made to the casing to remove it; or
3. The log evaluation shows significant material remaining in the outer annulus which would likely cause the casing to be stuck if pulling was to be attempted.

First Evaluation Determination

An initial option if the first evaluation is determined, is to repeat the washing step and log again if some material remains. Otherwise, if the log shows no remaining material in the outer annulus or adhering to the casing indicating that the clean is successful, the wash step in a perf wash and cement procedure has been verified. Referring to FIG. 1(*d*), a fluidised plugging material such as cement is put in the well to fill the outer annulus 30 and the casing 12 to create a plug 42 over the longitudinal section 22. As is known in the art, a spacer fluid may be used ahead of the cement to provide a final cleaning sweep before the cement is placed in and allowed to set. A cementing tool may be used to deposit the cement. Such a tool may provide a stinger to draw through the cement, blades or wipers to urge the cement through the perforations, and/or a flow modifier to create pulses in the cement or other agitation means to act on the cement and/or casing to encourage cement distribution through the outer annulus 30. Accordingly, the well 10 has been abandoned using the perf, wash and cement technique with the benefit of verification of the washing step. This is a preferred technique, if possible, as it leaves the casing 12 in the well 10. This should remove the requirement to drill out the plug, log the cemented outer annulus 30 and deposit a further cement plug inside the casing 12.

Second Evaluation Determination

Under this determination, the continuation of a perf wash and cement job would be known to create a cement plug which would be unreliable. However, the wash step and logging will indicate that any remaining material may be dislodged or broken if the casing 12 is pulled. In this case, the well is abandoned in a cut and pull procedure. As indicated in FIG. 1(*e*), the casing 12 is cut by a casing cutter 44 to provide a cut casing section 46, a casing spear 48 is then attached to the casing section 46 to remove it from the well by pulling of the string 16 to which the casing spear 48 is attached. The provides a clear cylindrical area 50 extending to the bore 14 or formation wall. Cement or other fluidised plugging material is deposited into the area 50 over the desired length 22 to create a plug 42 and abandon the well 10. A cementing tool in the form of a stinger may be used to assist in distributing the cement throughout the area 50. The final plug 42 is as illustrated in FIG. 1(*f*), showing the casing above the bridge plug 36 has been recovered.

Third Evaluation Determination

In the event that the log evaluation shows significant matter at one or more locations over the longitudinal section which has not been moved by washing and appears too dense for removal by pulling, as would typically be seen by significant cemented sections, milling is then undertaken.

Referring to FIG. 1(*g*), a section milling operation is shown. Milling of the casing 12 can be done in either an uphole or downhole direction using a section mill 52 located on the tool string 16. Those in the art will recognise that the milled longitudinal section 22 may also be reamed to ensure all material is removed back to the bore 14. This creates a clear cylindrical area 50 bordered by casing 12 above and below, into which a fluidised material such as cement is deposited to provide the plug 42 over the longitudinal section 22. This is as illustrated in FIG. 1(*h*).

In this way, the well is perforated, washed and logged before determining and then undertaking the most appropriate method of plugging the well to ensure integrity of the plug and well abandonment procedure.

The logging step can be made on a separate trip into the well as illustrated in FIG. 1(*c*). In this way the logging tool 38 or tools can be run on wireline or on tubing as appropriate. If run on tubing, data can be transmitted to surface by any telemetry method to speed up the analysis. The logging tool 38 can be mounted on a string along with other tools such as the wash tool and/or the perforating guns. In this way, the steps of perforating, washing and logging or the steps of washing and logging can be performed on a single trip in the well.

Figure 2:
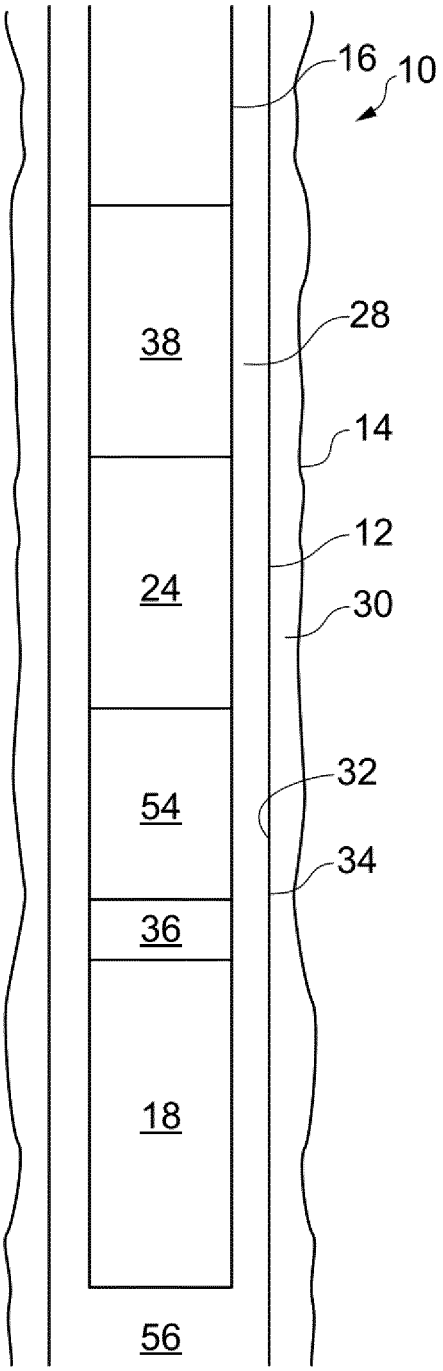
FIG. 2 is a schematic illustration of a string including tools for carrying out an embodiment of the method.

In an embodiment, perforating, washing, logging and cementing steps are performed in a single trip using a tool shown in FIG. 2. Like parts to those of previous Figures have been given the same reference numerals to aid clarity. On the tool string 16, there is mounted, perforating tool 18, bridge plug 36, cementing tool 54, wash tool 24 and logging tool 38.

Component parts on the string 16 may be formed integrally on a single tool body or may be constructed separately and joined together by box and pin sections as is known in the art. Other tools/parts may be present. The tools may be arranged in any order. For example, a flow modifier may be located in the string 16 to create pressure variations in the wash fluid and/or fluidised plugging material.

Tool string 16 may be a drill string or coiled tubing having a central throughbore 26 for the passage of fluid pumped from surface, as is known in the art.

The tool string 16 is run-in to the well 10. On run-in, if desired, the logging tool 38 can be operated to perform an initial or pre-processing outer annulus 30 evaluation log. This log will be used to determine the most preferential available position to locate the plug over the required length 22. This initial log can also be used for comparison and assistance in interpreting the later logging after the wash step. It is noted that, unlike the prior art perf wash and cement procedure which requires determination of a sufficient length of free pipe from the initial log, the present method allows selection of longitudinal sections of the wellbore having uncertain material characteristics from the log and offers the possibility of using the wash step to determine if these materials can be dislodged, broken down or moved.

Once a longitudinal section 22 has been selected, the perforating tool 38 is operated to create a spread of holes 20 through the wall of the casing 12. The holes or perforations 20 are spaced circumferentially around the casing 12 and extend along the casing 12 over the length 22. The outer annulus 30 is now accessible from the inner annulus 28 along the full length of the longitudinal section 22. It will be appreciated that the perforation could be performed over the entire longitudinal section at one time. For this there may be a plurality of perforating guns which extend over the full length of the longitudinal section so that the perforation holes can all be made together on a single detonation event.

At this stage, the perforating tool 18 is released from the string 16 and allowed to fall into the casing bore 56. In this way, the perforating tool 18 can be considered as sacrificial. However, it will be appreciated that the perforating tool 18 could be recovered to surface on the tool string 16. In this arrangement the bridge plug 36 would be arranged below the perforation tool 18 and the plug 36 would likely be set before detonation occurs.

With the perforating tool 18 released, plug 36 is now set in the casing 12 below the perforated holes 20. Plug 36 creates a seal across the casing 12 and provides a sealed section to the casing 12 preventing the passage of fluids across the plug 36 in either direction. Plug 36 is a bridge plug 36. Those skilled in the art will recognise that a cement retainer could be used in place of the bridge plug 36 with a stinger being located in the string 16 above the retainer. Once the plug 36 is set in the casing 12, the string 16 is detached from the plug 36 using known methods and the string 16 is positioned to allow washing of the casing 12 over the longitudinal section 22.

A washing fluid, typically viscosified brine, is pumped through the string 16 from surface and ejected from through ports or nozzles in the wash tool 24. The wash fluid is directed into the perforations 20 to clean the outer annulus 30. The inner and outer surfaces 32,34 of the casing 12 will also be cleaned.

If the tool string 16 includes a flow modifier device such as the Agitator™ System available from National Oilwell Varco, the washing fluid can be pulsed to aid the breakdown of materials in the outer annulus 30. The Agitator™ is described in U.S. Pat. Nos. 6,279,670, 7,077,205 and 9,045,958, the disclosures of which are incorporated herein in their entirety by reference. It will be appreciated that a surface device could be used to create cyclic pressure variations in the fluid and preferably pulses.

The wash tool 24 can be moved uphole or downhole to perform the wash, with the washing fluid containing debris and materials from the outer annulus 30 and surfaces 32,34 being circulated back to surface through the inner annulus 28.

Once cleaned, the well 10 is logged over the longitudinal section 22 using the logging tool 38. Data is transmitted to surface and analysed to select which of the three evaluation determinations presented above, is required. The logging tool 38 and tool string will remain in the well 10 at this time. If the first evaluation determination is selected, the log will have verified the wash step. A fluidised plugging material such as cement slurry can be down the throughbore 26 to exit at the cementing tool 54 and fill the casing bore 56 above the bridge plug 36. The cementing tool 54 may be used to urge the cement slurry through the perforations 20 so as to fill the outer annulus 30 also. As the inner 32 and outer 34 surfaces of the casing 12 have been shown to be clean by the log, the cement will adhere to these forming a cement bond. When a calculated volume of cement has been deposited to fill the outer annulus 30 and casing bore 56 to the top of the longitudinal section 22, the cement is left to set and create the plug 42.

If desired, before removal of the string 16, the set plug 42 can be tagged and pressure tested as is known in the art. In this way, a perf wash and cement procedure for well abandonment has been completed in which the wash step was verified by logging the well between the wash and cementing, in a single trip in a wellbore.

In the event that the log taken after the wash step gives selection of the second or third evaluation determination as described above, the string 16 is removed and a further string assembled to perform a cut and pull process or section milling as is known in the art.

Figure 3:
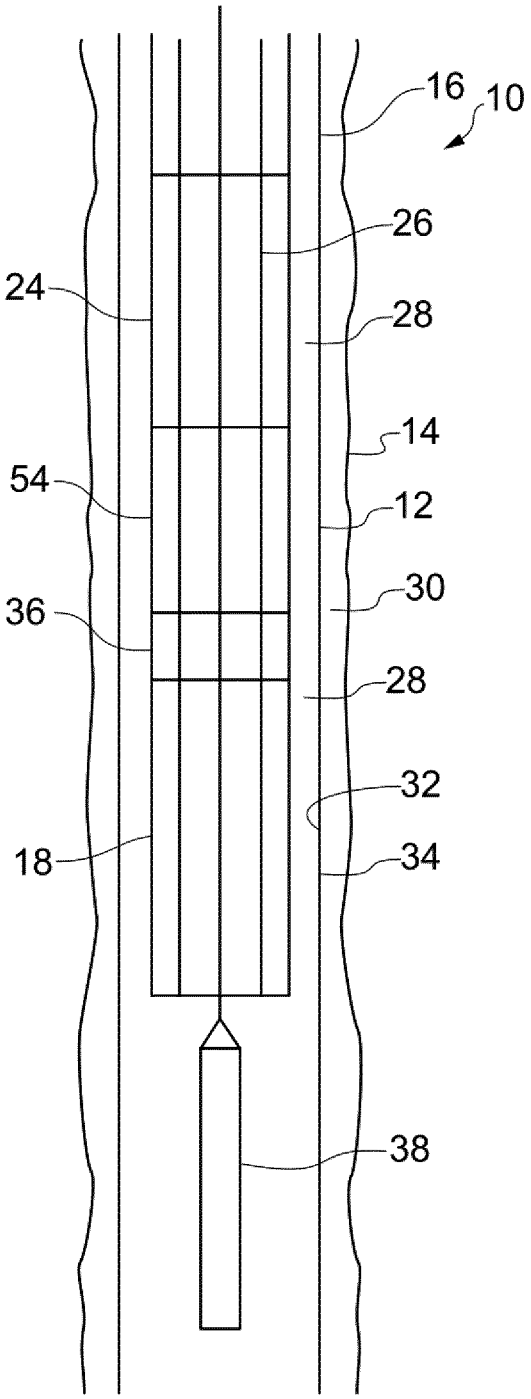
FIG. 3 is a schematic illustration of a through tubbing logging tool in a string including tools for carrying out an embodiment of the method.

An alternative embodiment for the arrangement of the tool string 16 shown in FIG. 2, is that shown in FIG. 3. Like parts to those of earlier Figures are given the same numbering to aid clarity. On the tool string 16, there is mounted, perforating tool 18, bridge plug 36, cementing tool 54 and wash tool 24 as may be found in prior art tool strings for perf, wash and cement. In this embodiment, there is a throughbore 26 in the string of sufficient clearance to run a through-tubing logging tool 38. The through tubbing logging tool 38 may be run on wireline.

The method steps would be the same until the log was required. At that time, the through tubing logging tool 38 would be inserted through the string 16 and allowed to exit at the bottom of the string 16 to make measurements to log the well 10 over the longitudinal section 22. This is as illustrated in FIG. 3. In this procedure, all the steps for a perf, wash and cement with logging to verify the wash can be made with the tool string 16 only making a single trip in the well 10.

Figure 4:
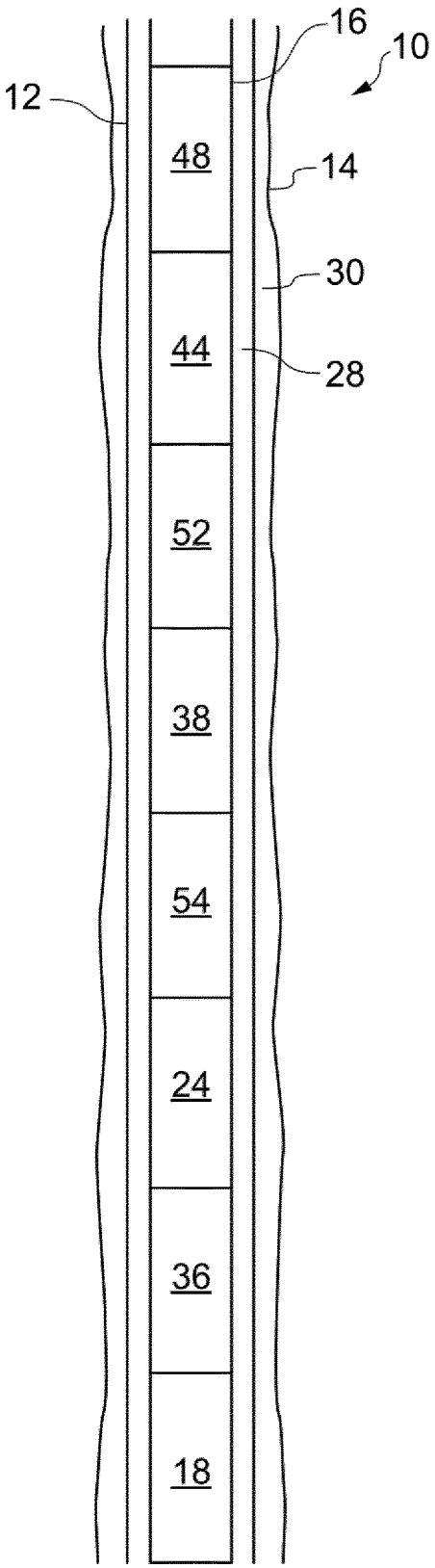
FIG. 4 is a schematic illustration of a string including tools for carrying out an embodiment of the method.

It will be realised that with successful tool design it could be possible to have a tool string 16 including all the tools required to perform the steps of the present invention for the three evaluation determinations so that the well abandonment procedure can be performed on a single trip in the well bore. A suggested tool string arrangement is illustrated schematically in FIG. 4. Like parts to those of earlier Figures are given the same reference numerals to aid clarity. The tool string 16 now comprises, a perforating tool 18, a bridge plug 36, a wash tool 24, a logging tool 38, a casing cutter 44, a casing spear 48, a section mill 52 and a cementing tool 54. While illustrated in one order, the relative placement of the components can be varied depending on operating modes e.g. drop balls and/or depending on which tool(s) may be sacrificial and left in the well bore. Such an arrangement allows the perforation of the casing 12; washing of the casing 12 and outer annulus 30; logging of the perforated length of casing 22; then by an evaluation determination either:

1. Cementing the outer annulus 30 and casing bore 56 to abandon the well in a perf, wash and cement procedure; or
2. Cutting the casing with the casing cutter, removing the cut casing using the casing spear and depositing cement to form a plug in a cut and pull well abandonment procedure; or
3. Section milling the casing over the longitudinal section and depositing cement to form a plug in a section milling well abandonment procedure.

It should be noted that while we refer to the plug being a cement plug, the plug can be formed of any fluidised plugging material. A cement slurry is typically used but the Applicants are aware of gels and other materials which may be used alone or in combination with cement to provide a fluidised material which sets hard and bonds to both the casing 12 and the bore or formation 14 of the well bore 10.

The principle advantage of the present invention is that it provides a method of well abandonment in which a wash step can be evaluated to determine the most appropriate technique for abandonment of the well.

A further advantage of the present invention is that it provides a method of well abandonment in which the wash step is verified in a perf, wash and cement abandonment technique, removing the requirement to drill the cemented plug to log the cemented outer annulus.

A yet further advantage of the present invention is that it provides a method of well abandonment that allows selection of longitudinal sections of the wellbore for location of the plug which would not normally be selected for perf wash and cement from an initial log due to having uncertain material characteristics and offers the possibility of using the wash step to determine if the materials can be dislodged, broken down or moved.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended. For example, while perforations through a single conduit are described the technique could be applied through multiple casing strings, or between casing strings. Further it will be appreciated that the non-essential method steps may be added to, changed or removed for a single trip.

I claim:

1. A method for well abandonment, in which a well bore has a conduit therein with an outer annulus behind the conduit, the method comprising the steps, in order:

providing a perforating tool, a wash tool, a logging tool and a cementing tool on the same string; and then:

(a) perforating the conduit to form a plurality of holes in the conduit over a longitudinal section of the well bore;

(b) passing a washing fluid into the outer annulus via at least one of said holes to wash the outer annulus;

(c) logging at least a portion of the washed outer annulus;

(d) pumping a fluidised plugging material into the well bore to create a plug over at least a portion of the longitudinal section of well bore;

wherein at least one log taken at step (c) is evaluated to determine effectiveness of washing in step (b) and select a plugging technique to use for step (d), the plugging technique being selected from:

(i) a perf wash and cement technique;

(ii) a cut and pull technique; and (iii) a section milling technique;

wherein the string remains in the well bore during evaluation of the at least one log and selection of the plugging technique; and wherein if plugging technique (i) is selected then step (d) is performed using the cementing tool on the string, and if plugging technique (ii) or (iii) is selected then the string is removed from the well bore and a further string is assembled for performing the cut and pull technique or the section milling technique in step (d).

2. The method for well abandonment according to claim 1, wherein the method includes repeating steps (b) and (c) before performing step (d).

3. The method for well abandonment according to claim 1, wherein if plugging technique (i) is selected then the method includes pumping the fluidised material through at least one of said holes in step (d) to plug the well using the perf wash and cement technique.

4. The method for well abandonment according to claim 1, wherein if plugging technique (ii) is selected then the method includes the steps of cutting and pulling the perforated conduit from the well bore between steps (c) and (d), to plug the well using the cut and pull technique.

5. The method for well abandonment according to claim 1, wherein if plugging technique (iii) is selected then the method includes the step of milling the conduit between steps (c) and (d), to plug the well using a section milling technique.

6. The method for well abandonment according to claim 1, wherein the logging step (c) is performed using one or more techniques from a group comprising: cement bond logs (CBL), cement mapping logs (CMT), ultrasonic cement mapping tools (CET), and ultrasonic imaging logs (USI, RBT).

7. The method for well abandonment according to claim 1, wherein the method includes the additional step of logging the well bore prior to step (a).

8. The method for well abandonment according to claim 1, wherein the method includes creating pressure variations in the washing fluid.

9. The method for well abandonment according to claim 1, wherein the method includes creating pressure variations in the fluidised plugging material.

10. The method for well abandonment according to claim 1, wherein in step (a) perforating is by operation of the perforating tool located on the string run into the conduit.

11. The method for well abandonment according to claim 10, wherein the perforating tool is one or more perforating guns.

12. The method for well abandonment according to claim 1, wherein the step of passing the washing fluid through the outer annulus is by jetting washing fluid from ports in the wash tool located on the string run into the conduit.

13. The method for well abandonment according to claim 1, wherein the step of passing the washing fluid through the outer annulus includes mechanically cleaning an inner surface of the conduit.

14. The method for well abandonment according to claim 1, wherein the fluidised plugging material is cement.

15. A method for abandoning a well, in which the well bore has a conduit therein with an outer annulus behind the conduit, the method comprising the steps, in order:

(a) perforating the conduit to form a plurality of holes in the conduit over a longitudinal section of the well bore;

(b) passing a washing fluid into the outer annulus via at least one of said holes to wash the outer annulus;

(c) logging at least a portion of the washed outer annulus;

(d) pumping a fluidised plugging material into the well to create a plug over at least a portion of the longitudinal section of well bore;

wherein the method includes performing the steps on a single trip in the wellbore, and the method includes providing a perforating tool, a wash tool and a cementing tool on the same string and running the logging tool through the string to perform step (c) with the string remaining in the wellbore to perform steps (a), (b) and (d).

16. A method for abandoning a well, in which the well bore has a conduit therein with an outer annulus behind the conduit, the method comprising the steps, in order:

(a) perforating the conduit to form a plurality of holes in the conduit over a longitudinal section of the well bore;

(b) passing a washing fluid into the outer annulus via at least one of said holes to wash the outer annulus;

(c) logging at least a portion of the washed outer annulus;

(d) pumping a fluidised plugging material into the well to create a plug over at least a portion of the longitudinal section of well bore;

wherein the method includes providing a perforating tool, a wash tool, a logging tool, a cementing tool, a casing cutter, a casing spear and a section mill on the same string and performing the method on a single trip in the wellbore together with the step of evaluating the log and performing a plugging and abandonment technique from a group comprising: perf, wash and cement; cut and pull; and section milling.

* * * * *